United States Patent [19]

Klancnik

[11] 4,021,809

[45] May 3, 1977

[54] ANTENNA COUPLINGS

[75] Inventor: John H. Klancnik, Des Plaines, Ill.

[73] Assignee: Afco Products Incorporated, DesPlaines, Ill.

[22] Filed: Oct. 16, 1975

[21] Appl. No.: 623,053

[52] U.S. Cl. ..... 343/715; 343/880; 343/882; 343/900

[51] Int. Cl.² ..... H01Q 1/32

[58] Field of Search ..... 343/715, 880, 714, 889, 343/901, 882, 900

[56] References Cited

UNITED STATES PATENTS

| | | | |
|---|---|---|---|
| 3,254,344 | 5/1966 | Rohrs | 343/901 |
| 3,359,559 | 12/1967 | Guinn | 343/901 |
| 3,898,666 | 8/1975 | Massa | 343/901 |

*Primary Examiner*—Harold A. Dixon
*Attorney, Agent, or Firm*—Kinzer, Plyer, Dron & McEachran

[57] ABSTRACT

An antenna coupling enabling the antenna to be quickly detached but incorporating a lock to forestall theft.

10 Claims, 4 Drawing Figures

ANTENNA COUPLINGS

This invention relates to a vehicle mounted antenna and in particular to a coupling detachably mounting the antenna to the vehicle for quick detachment but yet in such a fashion as to reduce the possibility of theft.

The so-called citizen band radio ("CB") is becoming increasingly popular as an automotive accessory. The CB antenna, supported on the outside of an automobile, requires a coupling that can be easily released in order that the antenna may be removed without special tools, as when the vehicle is washed. However, this makes theft of the antenna an attractive proposition and the primary object of the present invention is to discourage theft by devising a coupling which requires knowledge of the manner in which uncoupling may be readily accomplished. Specifically it is an object of the present invention to devise an antenna coupling (detachably coupling the antenna to a vehicle) in which two principal coupling members can be readily separated only when a lock pin has been rotated to a particular position. Any person not having knowledge of the release position of the lock pin will either be completely discouraged from an attempted theft or will find himself involved in a time consuming effort to fathom the secret of detachment. No device is fool-proof because fools are too ingenious, but nonetheless a thief is ordinarily unwilling to tolerate a time lapse in which an attempted theft may be discovered, especially the impatient hit-and-run thief whose proclivities involve unattended automobiles.

Specifically it is an object of the present invention to enable quick detachment to be realized, while confusing the thief, by devising a coupling having a shell member and a stud member, one of which fits to the vehicle and the other of which supports the antenna; one of the members has a lock pin and the other member has a pin escape slot, for which there is only one rotary position between the members permissive of release, thereby confronting the thief with a problem.

It should be stressed that while the antenna may be threadedly connected to the coupling the antenna itself is so configured (a known configuration) that special tools are required to take it off; this is equally true of a threaded connection between the coupling itself and the base mount on the vehicle.

Figure 1:
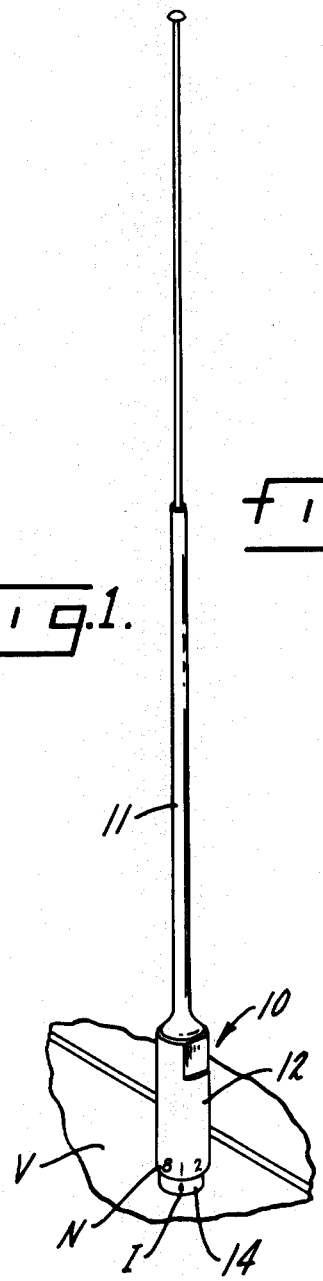
FIG. 1 is a perspective view of an antenna detachably coupled to a vehicle in accordance with the present invention.

The coupling 10 of the present invention is adapted to detachably support an antenna 11, FIG. 1, to a part of a vehicle V and includes a shell member 12 and a stud member 14. The two members respectively have means thereon enabling one member to be secured to a base mount on the vehicle and enabling the antenna to be connected to the coupling.

The shell member 12 may be the member to which the antenna is connected and accordingly one end of the shell is provided with a tapped opening 16 to which the antenna may be threadedly joined. The configuration is such that specialized tools are ordinarily required to disconnect the antenna after it has been attached.

The shell member 12 is of tubular form and is provided with a recess or bore 18 to receive a first portion 20 of the stud member. The stud member 14 has an intermediate enlarged portion 22 which extends outwardly of the recess 18 and the extended end portion thereof is provided with an external thread 24 to enable the coupling to be secured to the vehicle. Again the configuration is such that a special wrench is required to detach the stud member from the base mount of the vehicle to which it is related.

One of the members carries a lock pin which has only one position compared to the other member allowing quick separation. In the form of the invention disclosed herein, the lock pin, 26, is carried by the stud member 14, being fixed to portion 20 thereof to project radially therefrom.

Figure 2:
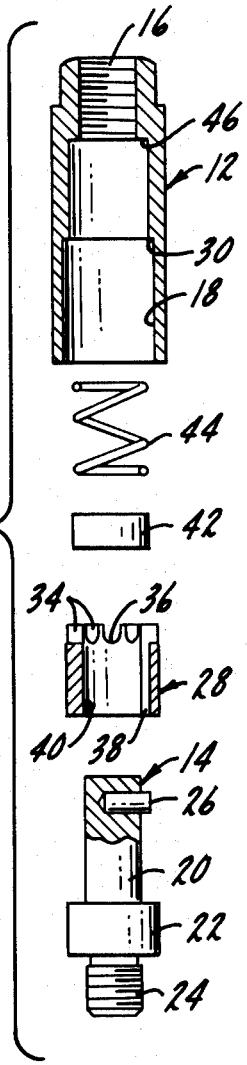
FIG. 2 is an exploded sectional view of the coupling.
Figure 3:
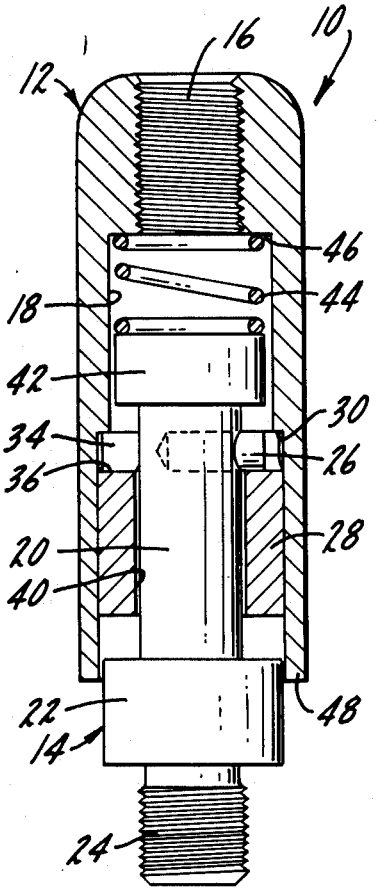
FIG. 3 is a sectional view, on an enlarged scale compared to FIG. 2, of the coupling in its assembled form.
Figure 4:
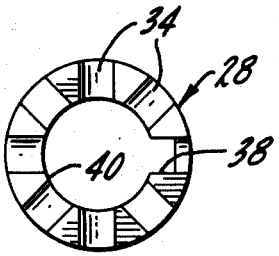
FIG. 4 is a plan view of a sleeve.

The other member, the shell 12, is provided with an escape slot, permissive of separation of the members, and is also preferably formed with a plurality of false openings, constituting stops which are impermissive of escape of the pin. To this end a sleeve 28, FIG. 2, is press-fitted into the base 18 of the shell member, engaging a stop shoulder 30. The inward-most end of sleeve 28 is provided with a plurality of openings 34 each having a dead end 36 constituting a stop for lock pin 26, when disposed therein. The openings are interconnected in the sense of being joined to or provided on the same part. Sleeve 28 is also provided with a broached escape slot 38 which, as shown in FIG. 2, extends from one end of the sleeve 28 to the other. The sleeve 28 is formed with a bore 40 enabling portion 20 of the stud to be freely extended therethrough when the lock pin is aligned with the escape slot 38.

An electrical contact plug 42 sets freely on the end of stud 14 inside recess 18. A coil spring 44 is interposed between the contact plug 42 and a spring stop shoulder 46 at the inner end of the shell bore 18. The spring 44 acts between the shell 12 and plug 42 to apply a spring force to stud 20 (through plug 42) tending to firmly urge lock pin 26 against the end of sleeve 28 having the openings formed therein.

The coupling is assembled by first disposing spring 44 in the bore 18, then positioning the stop plug 42 in contact with the spring. The sleeve 28 is then press-fitted in place. With pin 26 fixed to stud 20, the coupling may be assembled by aligning pin 26 with slot 38, the stud then being pressed home until the pin 26 is beyond the end of sleeve 28 having the openings. The stud may then be turned, whereupon spring 44 holds the pin against the inner end of the sleeve 28.

The parts can be separated only by pushing on the stud (or pressing on the shell) to displace pin 26 from the end of sleeve 28 having the openings 34 and producing relative rotation until the pin is aligned with the escape slot 38.

To afford a weather seal, the shell includes a skirt portion 48 which overlaps the enlarged portion 22 of the stud member extending externally of the shell recess 18.

To identify the position where the escape slot is aligned with the pin, marks may be scribed on the skirt portion 48 and at the opposed position of the stud member. The scribe marks may be mere hair lines but preferably numerals N are employed in conjunction with an index mark I, respectively on the two members, as shown in FIG. 1. Only one numeral identifies the location of the slot and consequently even if the principle becomes general knowledge the potential thief will be confronted with the plan proposition that he has got to spend time hunting for the correct alignment.

It will be seen from the foregoing that under the present invention the shell and stud members are respectively adapted to be attached to the antenna and the base mount of the vehicle. These members can be separated only when the pin 26 is aligned with the escape slot 38, easily identified by the knowledgeable person, but one who is not knowledgeable is either completely curbed from an attempted theft or foregoes the attempt on realizing it will be necessary to hunt for the alignment which allows quick separation.

I claim:

1. A coupling for a vehicle-mounted antenna for coupling the antenna to a mount attached to a part of the vehicle while permitting detachment of the antenna and comprising:

a shell member having an axially extending internal recess;

a stud member having a first portion disposed in said recess and a second portion extending axially thereof;

said members being relatively moveable, both axially and rotatably, and respectively having means carried thereby enabling the coupling to be attached to the base mount and enabling the antenna to be attached to the coupling;

one of said members having a lock pin fixed thereto;

the other of said members having an internal surface presenting a plurality of interconnected openings circumferentially spaced from one another for receiving the pin, each opening presenting a dead-end stop impermissive of axial separation of the members when the pin is disposed therein while yet permitting rotation and positioning of the pin in adjacent slots;

a spring means applying an axial force between said members tending to hold the pin disposed in an opening;

and said other member having an axially extending slot therein interconnected with and positioned between an adjacent pair of openings and at having a stop which, when the pin is aligned therewith, is permissive of the members being separated axially along with the antenna carried by one of the separated members, whereby knowledge of the location of the slot allows quick separation but lack of knowledge requires hunting for the slot.

2. A coupling according to claim 1 in which the pin extends radially.

3. A coupling according to claim 1 in which the members are scribed with marks including numerals identifying the position where the pin is aligned with the slot.

4. A coupling according to claim 3 in which the pin extends radially from the stud member.

5. A coupling according to claim 1 in which the pin is carried by the portion of said stud member disposed in the recess.

6. A coupling for a vehicle-mounted antenna for coupling the antenna to a mount attached to a part of the vehicle while permitting detachment of the antenna and comprising:

a shell member having an axially extending internal recess;

a stud member having a first portion axially disposed in said recess and a second portion extending axially thereof;

said members being relatively rotatable and respectively having means carried thereby enabling the coupling to be attached to the base mount and enabling the antenna to be attached to the coupling;

one of said members having a lock pin fixed thereto and the other of said members having a sleeve a plurality of interconnected openings each presenting a fixed stop surface engageable by the pin;

spring means disposed in said recess and applying an axial force to hold said pin engaged with said surface;

said sleeve having a slot interconnected with said openings and not having a stop and extending axially therethrough which, when the pin is aligned therewith upon rotation of said one member, is permissive of the members being separated along with the antenna carried by one of the separated members, whereby knowledge of the location of the slot allows quick separation but lack of knowledge requires hunting for the slot.

7. A coupling according to claim 6 in which the members are scribed with marks identifying the position where the pin is aligned with the slot.

8. A coupling according to claim 7 in which the marks include numerals.

9. A coupling according to claim 6 in which the pin is carried radially by the portion of said stud member disposed in the recess.

10. A coupling according to claim 9 in which the shell has a skirt overlapping the external portion of the stud to afford a weather seal.

* * * * *